US006315613B1

(12) United States Patent
Cheng et al.

(10) Patent No.: US 6,315,613 B1
(45) Date of Patent: Nov. 13, 2001

(54) FUSE COUPLER COMBINATION

(76) Inventors: Wen Tsung Cheng; Wen Ho Cheng, both of 6F, No. 440-2, Gin Pin Road, Chong Ho City, Taipei Hsien 235 (TW)

( * ) Notice: Subject to any disclaimer, the term of this patent is extended or adjusted under 35 U.S.C. 154(b) by 0 days.

(21) Appl. No.: 09/775,180

(22) Filed: Jan. 30, 2001

(51) Int. Cl.[7] ..... H01R 13/66
(52) U.S. Cl. ..... 439/621
(58) Field of Search ..... 439/621, 784, 439/766, 805, 830–837, 839, 840

(56) References Cited

U.S. PATENT DOCUMENTS 5,362,253 11/1994 Lin et al. ..... 439/462
5,440,073 8/1995 Lin et al. ..... 174/74 R
5,573,423 11/1996 Lin et al. ..... 439/462
5,573,433 11/1996 Lin et al. ..... 439/805
5,772,473 * 6/1998 Cheng et al. ..... 439/621
5,888,098 * 3/1999 Cheng et al. ..... 439/621
5,899,777 5/1999 Liang ..... 439/805
6,162,098 * 12/2000 Cheng et al. ..... 439/621

* cited by examiner

*Primary Examiner*—Tulsidas Patel

(57) ABSTRACT

A fuse coupler device includes one or two fuse couplers received in a housing and each having a socket formed on one end for engaging with a fuse member, a control ferrule includes an outer thread for threading with the fuse coupler, and a barrel is rotatably secured to the control ferrule. An electric wire has one end secured between the barrel and the fuse coupler by the control ferrule without additional fasteners and tools. The fuse member and the fuse coupler may be received in a housing, and a cap may be threaded to the housing for retaining the fuse member in the housing.

1 Claim, 6 Drawing Sheets

FUSE COUPLER COMBINATION

BACKGROUND OF THE INVENTION

1. Field of the Invention

The present invention relates to a coupler. and more particularly to a fuse coupler combination.

2. Description of the Prior Art

U.S. Pat. No. 5,362,253 to Lin et al., U.S. Pat. No. 5,440,073 to Lin et al., U.S. Pat. No. 5,573,423 to Lin et al. U.S. Pat. No. 5,573,433 to Lin et al., and U.S. Pat. No. 5,599,777 to Liang disclose various kinds of typical cable mounting devices or cable couplers having an electric wire coupled to a conductive connector without additional fasteners. However, the conductive connector is also required to be secured or attached to the other supporting casing or fuse receiving housing with the other fasteners, such that the other tools and fasteners are also required for securing the conductive connector to the other supporting casings or housings.

The present invention has arisen to mitigate and/or obviate the afore-described disadvantages of the conventional cable couplers.

SUMMARY OF THE INVENTION

The primary objective of the present invention is to provide a fuse coupler combination for securing the electric wire to the fuse without additional tools.

In accordance with one aspect of the invention, there is provided a fuse coupler combination comprising a fuse coupler including a first end having a socket provided thereon, and including a second end having a chamber and an inner thread formed therein, a fuse member including a first end engaged into the socket, a control ferrule including an outer thread formed thereon for threading with the inner thread of the fuse coupler and for securing the control ferrule to the second end of the fuse coupler, a barrel rotatably secured to the control ferrule and received in the chamber of the fuse coupler, and an electric wire including a first end received in the chamber of the fuse coupler and engaged between the barrel and the fuse coupler, for allowing the first end of the electric wire to be secured between the barrel and the fuse coupler by the control ferrule.

The control ferrule includes a bore formed therein for receiving the electric wire, and includes a peripheral rib extended radially inward of the bore thereof for defining a peripheral shoulder therein, the barrel includes a bore formed therein for receiving the electric wire and includes a first end bent relative to the barrel and engaged with the peripheral rib of the control ferrule for rotatably securing the barrel to the control ferrule.

The first end of the barrel includes a cylindrical member having a reduced diameter relative to the barrel for defining a peripheral shoulder between the barrel and the cylindrical member and for engaging with the control ferrule.

A housing is further provided for receiving the fuse member and the fuse coupler, and a cap is engaged onto the housing and engaged with the control ferrule for retaining the fuse member and the fuse coupler and the control ferrule in the housing.

Further objectives and advantages of the present invention will become apparent from a careful reading of a detailed description provided hereinbelow. with appropriate reference to accompanying drawings.

DETAILED DESCRIPTION OF THE PREFERRED EMBODIMENT

Figure 1:
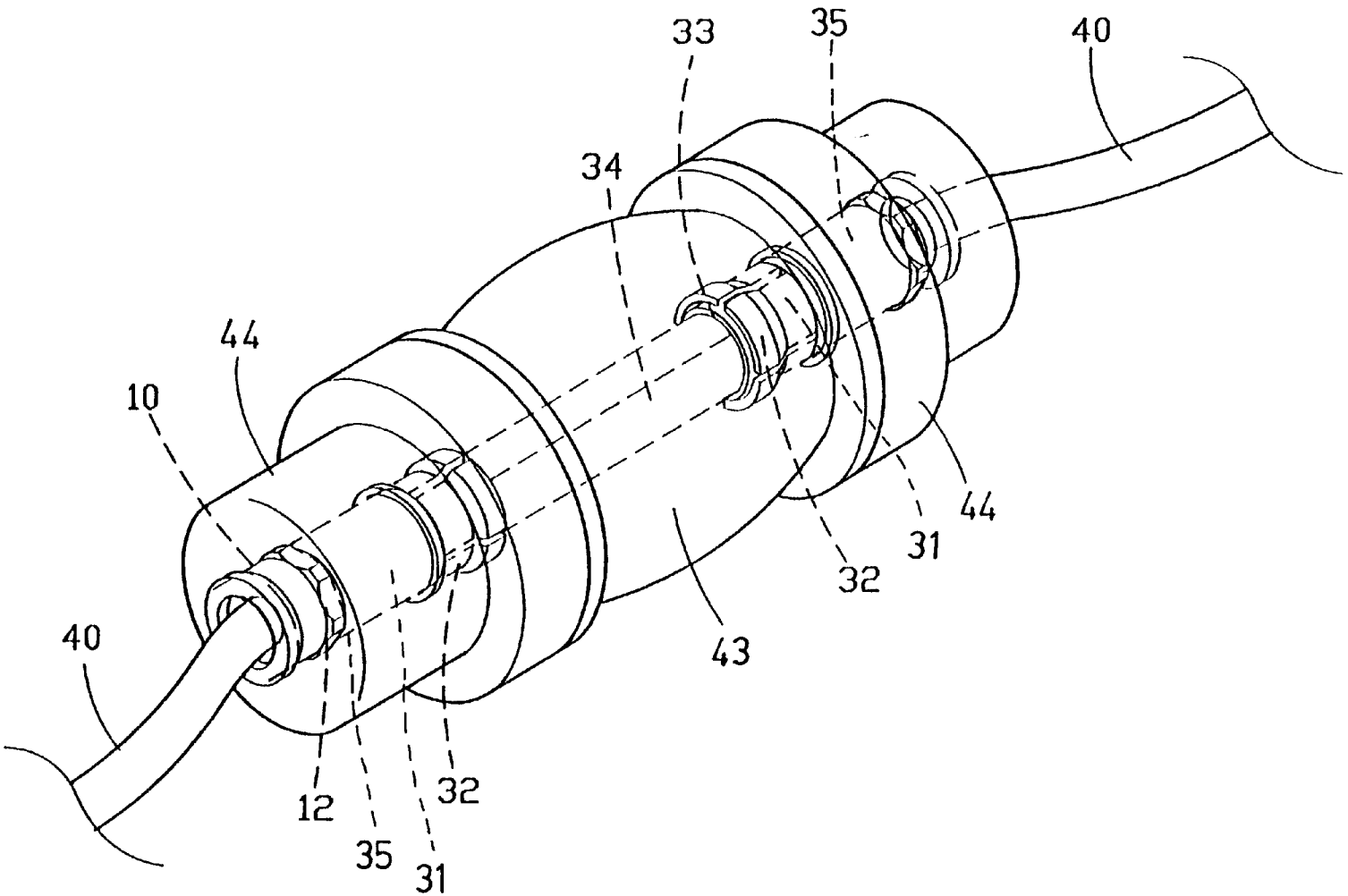
FIG. 1 is a perspective view of a fuse coupler combination in accordance with the present invention.
Figure 3:
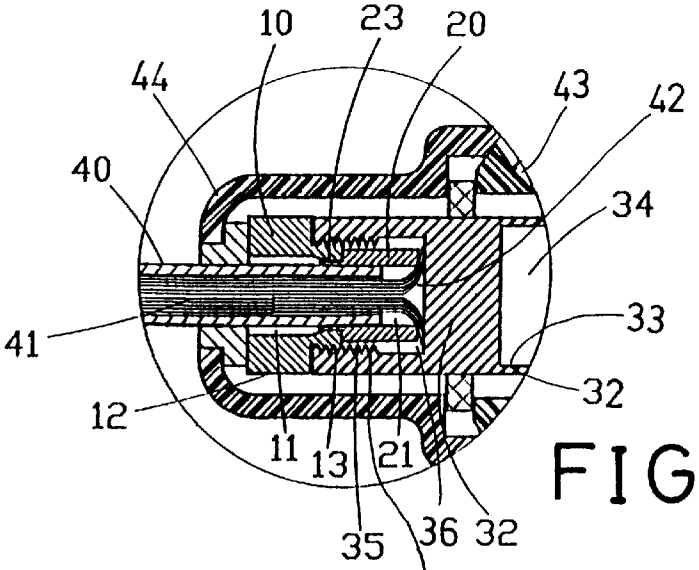
FIG. 3 is an enlarged partial cross sectional view of the fuse coupler combination.
Figure 2:
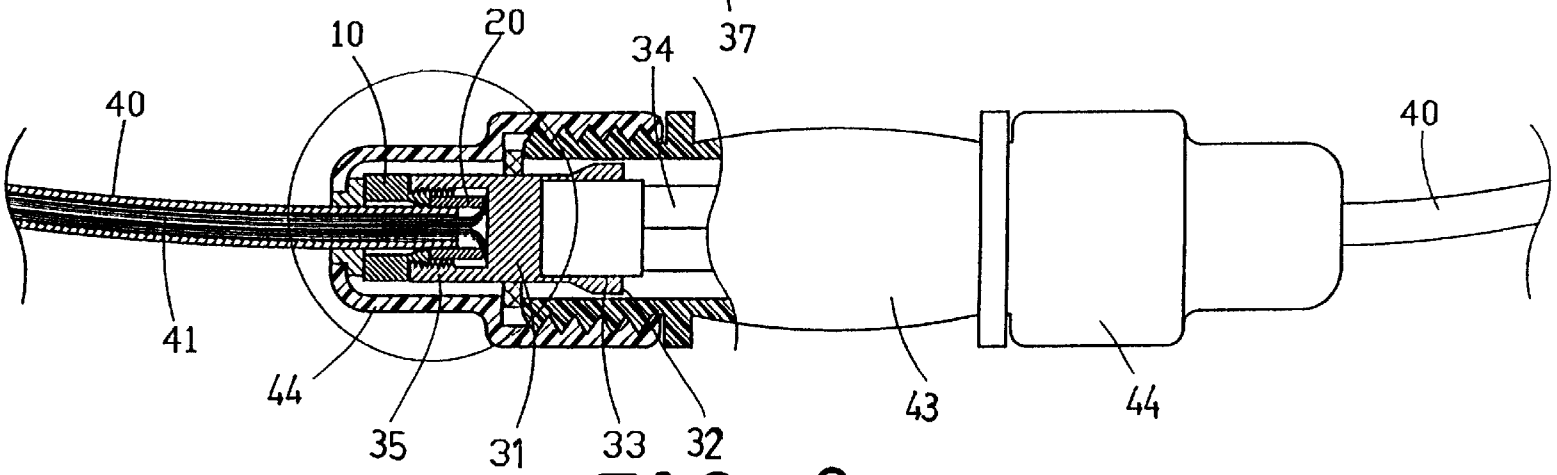
FIG. 2 is a plane view of the fuse coupler combination, in which a portion of the fuse coupler combination is cut off for showing the inner structure of the fuse coupler combination.

Referring to the drawings, and initially to FIGS. 1–3, a fuse coupler combination in accordance with the present invention comprises one or more fuse couplers 31, such as two fuse couplers 31 (FIG. 1) each including a socket 32 provided on one end thereof and having a socket opening 33 formed therein for receiving and plugging one end of a fuse member 34, and including the other end 35 having a chamber 36 formed therein and having an inner thread 37 formed therein. An electric wire 41 is to be electrically coupled to the other end 35 of the fuse coupler 31 and has a protective covering 40 provided on the outer portion thereof.

Figure 6:
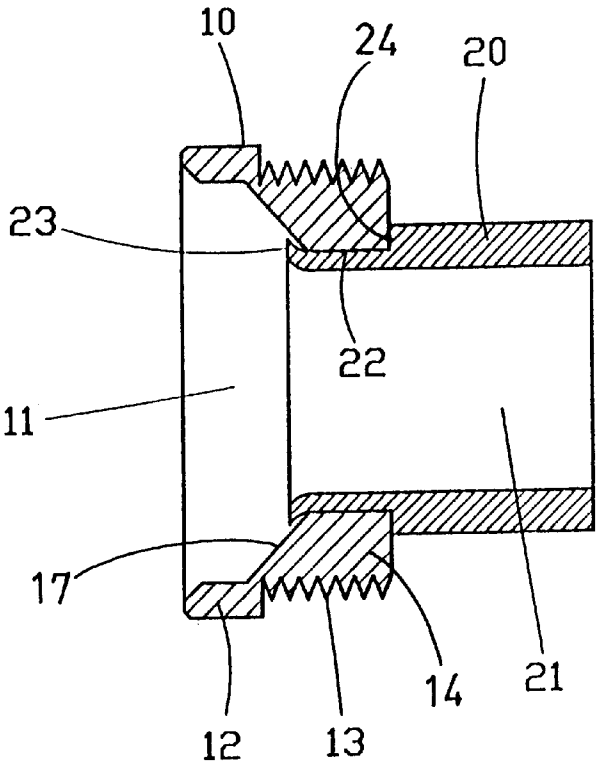
FIG. 6 is a cross sectional view taken along lines 6—6 of FIG. 4.
Figure 4:
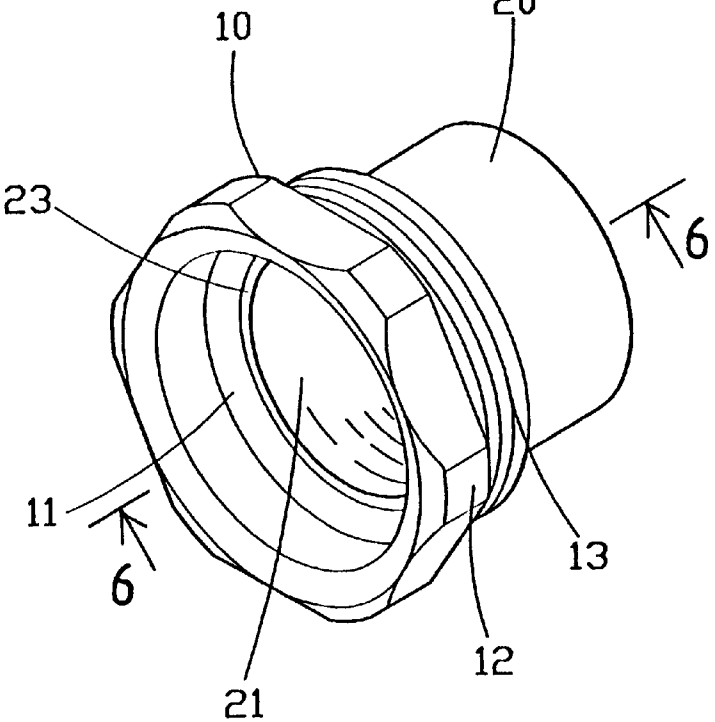
FIG. 4 is a perspective view of a connector device of the fuse coupler combination.
Figure 5:
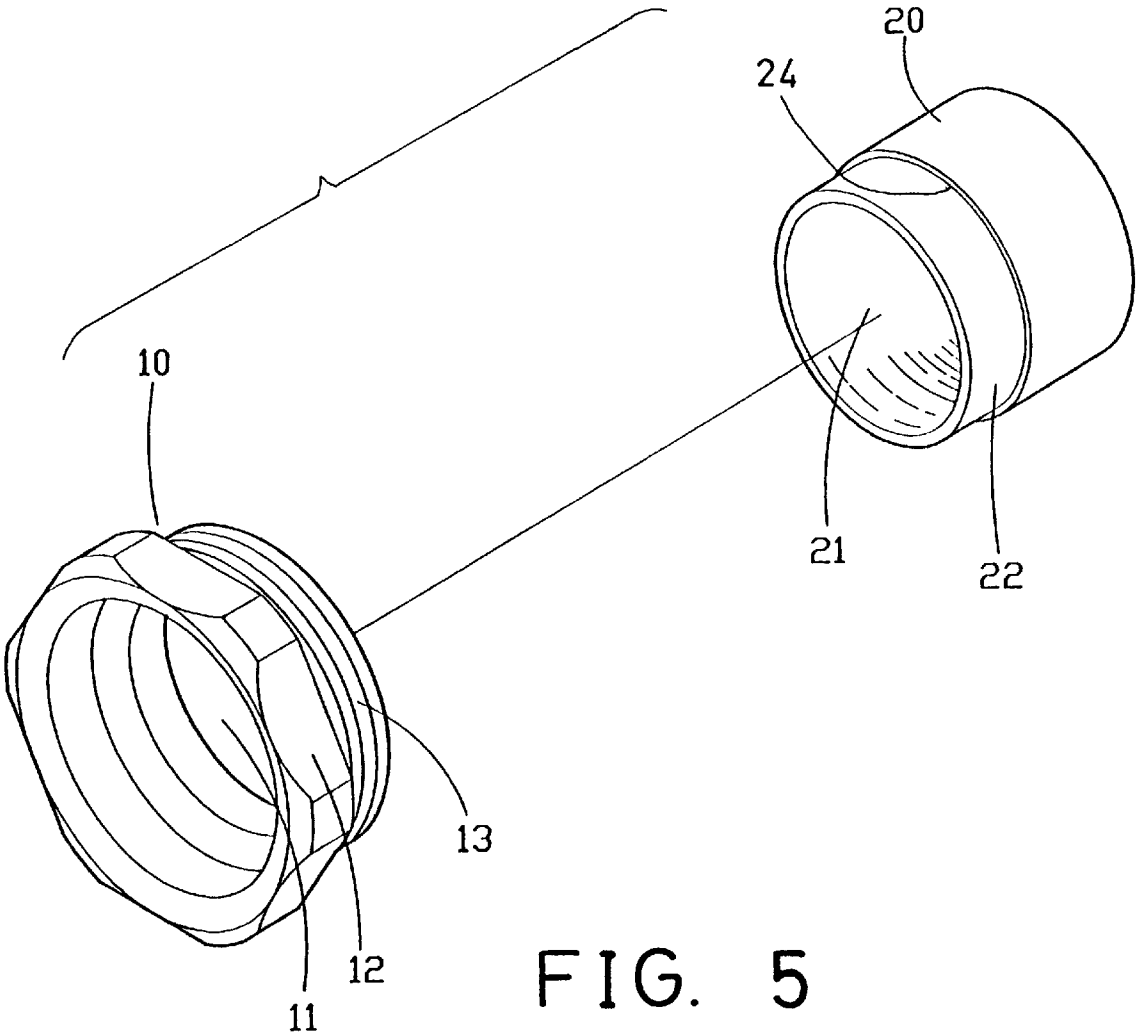
FIG. 5 is an exploded view of the connector device of the fuse coupler combination.

Referring next to FIGS. 4–6. illustrated is a connector device for electrically coupling the electric wire 41 to the fuse coupler 31 of the fuse coupler combination. The connector device includes a control ferrule 10 having a bore 11 formed therein for receiving the electric wire 41, and having an outer thread 13 formed on the outer peripheral portion thereof for threading with the inner thread 37 of the fuse coupler 31, and having a control knob 12 provided thereon for rotating the control ferrule 10 relative to the fuse coupler 31 and for securing the control ferrule 10 to the fuse coupler 31. The control ferrule 10 includes a peripheral rib 14 extended radially inward of the bore 11 thereof for defining a peripheral shoulder 17 therein. A barrel 20 also includes a bore 21 formed therein for receiving the electric wire 41 and includes a cylindrical member 22 having a reduced diameter as compared with that of the barrel 20 for forming or defining a peripheral shoulder 24 between the barrel 20 and the cylindrical member 22 and for engaging with the control ferrule 10. As best shown in the free end 23 (FIGS. 4, 6) of the cylindrical member 22 is riveted or bent radially outward to engage with the peripheral shoulder 17 of the control ferrule 10 for rotatably securing the barrel 20 to the control ferrule 10.

Referring again to FIGS. 2 and 3. the electric wire 41 includes a free end 42 bent relative to the barrel 20 and engaged and secured between the barrel 20 and the fuse coupler 31 by rotating and securing the control ferrule 10 relative to the fuse coupler 31. The electric wire 41 may thus be directly and easily coupled to the fuse member 34 with the fuse coupler 31 without additional fasteners. As shown in FIGS. 1 and 2. two fuse couplers 31 may be received in a housing 43 for securing the fuse member 34 therebetween. The electric wires 41 may be secured to the ends o f the fuse couplers 31 with the control ferrules 10 and the barrels 20. Two caps 44 may be attached to or received in the ends of the housing 43 and engaged with the control ferrules 10 and threaded to the housing 43 for retaining the fuse couplers 31 and the fuse member 34 in the housing 43.

Figure 7:
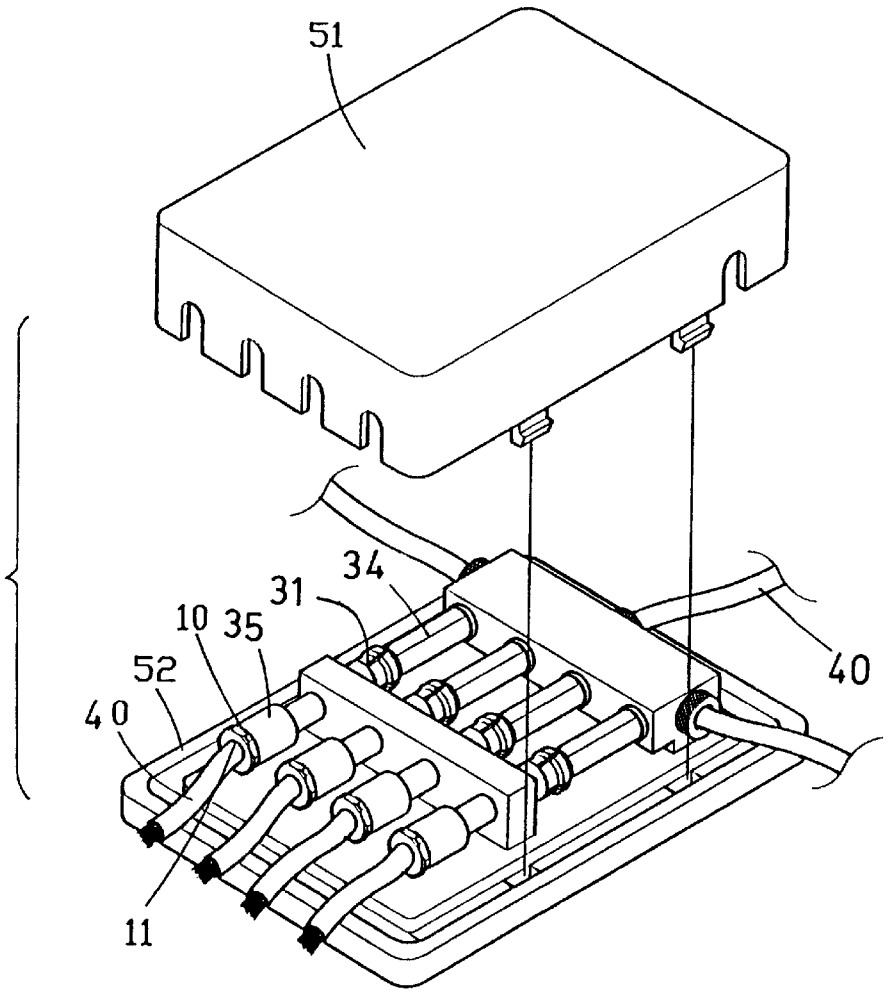
FIG. 7 is a partial exploded view showing the other embodiment of the fuse coupler combination.
Figure 9:
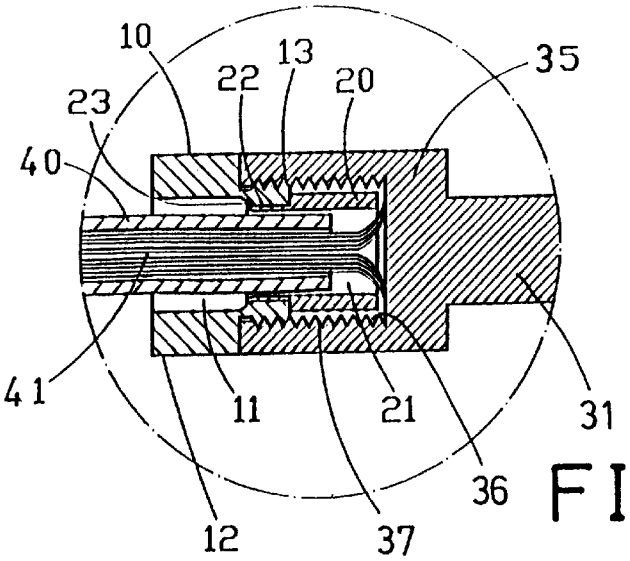
FIG. 9 is an enlarged partial cross sectional view of the fuse coupler combination as shown in FIGS. 7 and 8.
Figure 8:
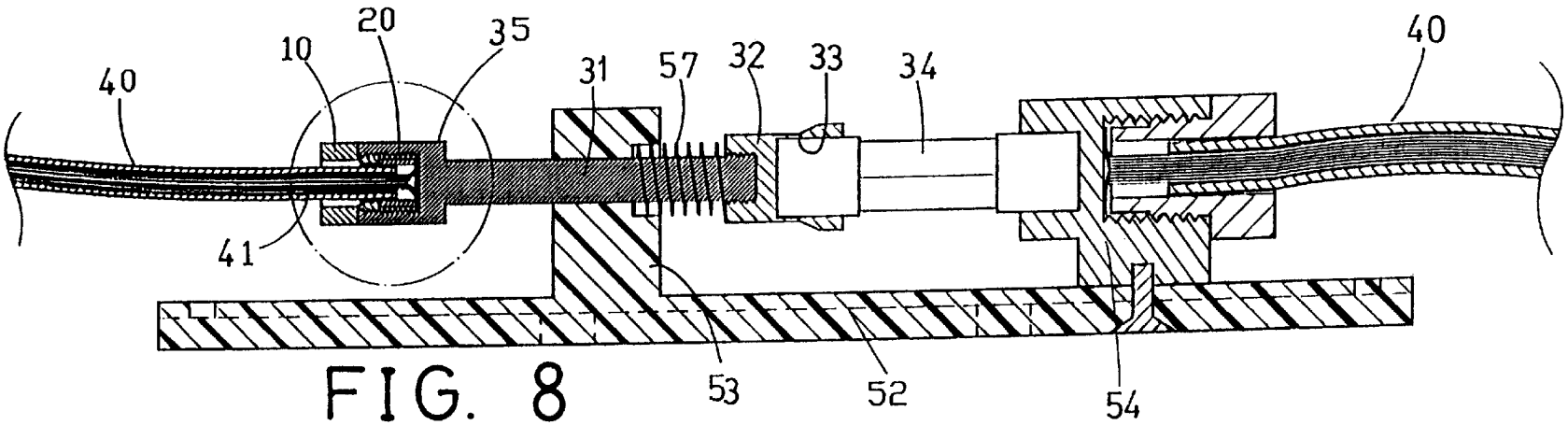
FIG. 8 is a partial cross sectional view of the fuse coupler combination as shown in FIG. 7.

Referring next to FIGS. 7–9, a cover 51 may be secured to a base 52 which has an extension 53 and a socket 54 extended therefrom. One or more fuse couplers 31 are slidably engaged through the extension 53 of the base 52. The fuse members 34 may be engaged between the sockets 32 of the fuse couplers 31 and the sockets 54. One or more springs 57 may be engaged on the fuse couplers 31 and engaged between the sockets 32 and the extension 53 for biasing the socket 32 to solidly engage with the fuse member 34.

It is to be noted that the fuse couplers 31 may be directly coupled to the fuse members 34 and may be easily and quickly coupled to the electric wires 41 with the control ferrule 10 without additional fasteners and tools. The barrel 20 may be solidly engaged with the electric wire 41 and will not be rotated relative to the control ferrule 10 with the control ferrule 10 is rotated and threaded to the fuse coupler 31.

Accordingly, the fuse coupler combination in accordance with the present invention may be used for securing the electric wire to the fuse without additional tools.

Although this invention has been described with a certain degree of particularity it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A fuse coupler combination comprising:

a housing, two fuse couplers received in said housing and each including a first end having a socket provided thereon and each including a second end having a chamber and an inner thread formed therein, a fuse member engaged in said sockets of said fuse couplers, two control ferrules each including an outer thread formed thereon for threading with said inner thread of said fuse coupler and for securing said control ferrules to said second ends of said fuse couplers, said control ferrules each including a bore formed therein, and each including a peripheral rib extended radially inward of said bore thereof for defining a peripheral shoulder therein, two barrels rotatably secured to said control ferrules and received in said chamber of said fuse couplers respectively, said barrels each including a bore formed therein and each including a first end bent relative to said barrel and engaged with said peripheral rib of said control ferrule for rotatably securing said barrel to said control ferrule, said first ends of said barrels each including a cylindrical member having a reduced diameter relative to said barrel for defining a peripheral shoulder between said barrel and said cylindrical member and for engaging with said control ferrule, and two electric wires each including a first end engaged through said bores of said control ferrules and said bores of said barrels respectively and received in said chamber of said fuse coupler and engaged between said barrel and said fuse coupler respectively, for allowing said first ends of said electric wires to be secured between said barrels and said fuse couplers by said control ferrules respectively.

* * * * *